United States Patent [19]

Centafanti

[11] 4,413,821

[45] Nov. 8, 1983

[54] TREADMILL EXERCISER

[76] Inventor: Rocco Centafanti, 27 India St., Portland, Me.

[21] Appl. No.: 279,320

[22] Filed: Jul. 1, 1981

[51] Int. Cl.[3] ..... A63B 23/06

[52] U.S. Cl. ..... 272/69

[58] Field of Search ..... 272/69, 73; 434/255, 434/250, 247

[56] References Cited

U.S. PATENT DOCUMENTS

| | | | |
|---|---|---|---|
| 1,919,627 | 7/1933 | Fitzgerald | 272/69 |
| 3,193,287 | 7/1965 | Robinson | 272/69 |
| 3,492,582 | 1/1970 | Heywood | 434/255 X |
| 3,580,083 | 5/1971 | Zipser | 73/432 R |
| 3,903,613 | 9/1975 | Bisberg | 272/73 X |
| 3,973,251 | 8/1976 | Stephas | 340/309.1 |
| 4,274,625 | 6/1981 | Gaetano | 272/69 |
| 4,278,095 | 7/1981 | Lapeyre | 272/69 X |

FOREIGN PATENT DOCUMENTS

| | | | |
|---|---|---|---|
| 2188 | 6/1979 | European Pat. Off. | 272/69 |
| 25888 | 1/1903 | Fed. Rep. of Germany | 272/63 |
| 416105 | 9/1934 | United Kingdom | 272/69 |

OTHER PUBLICATIONS

George Washington University "G W Times" May/-Jun. 1974, p. 11, On the Treadmill.

Quinton Instruments, Seattle, Wash. 1974 Catalog Inside of Cover. Man Walking on Treadmill with Spacesuit.

Radio Hat, Edsujo, Inc. Seaford, N.Y. Popular Science, Nov. 1980, p. 116.

*Primary Examiner*—Robert A. Hafer

*Assistant Examiner*—Arnold W. Kramer

[57] ABSTRACT

A treadmill exerciser is used in conjunction with a record or tape deck player providing music selected to provide both a tempo automatically inviting the exerciser to maintain a particular pace and the means by which the interest of the exerciser is maintained throughout the exercise period. The treadmill supports the music source and is adjustable to enable the exerciser to use body and arm movements in following the music.

4 Claims, 2 Drawing Figures

TREADMILL EXERCISER

BACKGROUND REFERENCES

U.S. Pat. No. 1,919,627
U.S. Pat. No. 3,580,083
U.S. Pat. No. 3,973,251

BACKGROUND OF THE INVENTION

The importance of regular exercise is widely appreciated for reasons ranging from the need to control weight to programs for those recovering from heart aliments.

While the type and extent of the exercise individuals practice often depends on a physician's recommendations, it is recognized that exercise should not only be regular but also sufficiently strenous to cause the heart beat to be accelerated for a reasonable but substantial interval.

For many, exercise outdoors is preferred with jogging popular while others enjoy brisk walks. For others, however, weather conditions and the character of the neighborhood make exercise indoors preferable although it is then usually necessary to use a captive bicycle or a treadmill exerciser.

Such devices, however, are monotonous to use as a consequence of which, interest in an exercise program is often lost so that what is needed is a way to make the use of such devices a pleasurable interval with the exercise automatically taking place.

THE PRESENT INVENTION

The general objective of the present invention is to make indoor exercising with a treadmill a pleasant interval with the wanted exercise interval and rate automatically established and with an increased range of muscular activity.

The requirements of the apparatus will be apparent from a general summary of the method which requires that a tape be used having at least one section of recorded music, either dance or march music, of a wanted tempo and providing an exercise interval of a wanted length. The music is selected by the person using the treadmill as that which will hold his interest throughout that interval so that his steps will automatically correspond to the tempo of the music and the music invites body and arm movements as well as movements of the person lengthwise and from side-to-side of the movable support of the treadmill.

While the length of the interval and the tempo of the music may be varied, for a person not subject to medically imposed limitations, a tempo that compels approximately one hundred twenty steps per minute and an exercise interval of at least fifteen minutes have been found suitable.

It is, accordingly, necessary that the treadmill be such that increased muscular activity can be accommodated and desirably enable the music source to be included in the treadmill structure.

BRIEF DESCRIPTION OF THE DRAWINGS

The accompanying drawings illustrate a preferred embodiment of the treadmill

THE PREFERRED EMBODIMENT OF THE INVENTION

Figure 1:
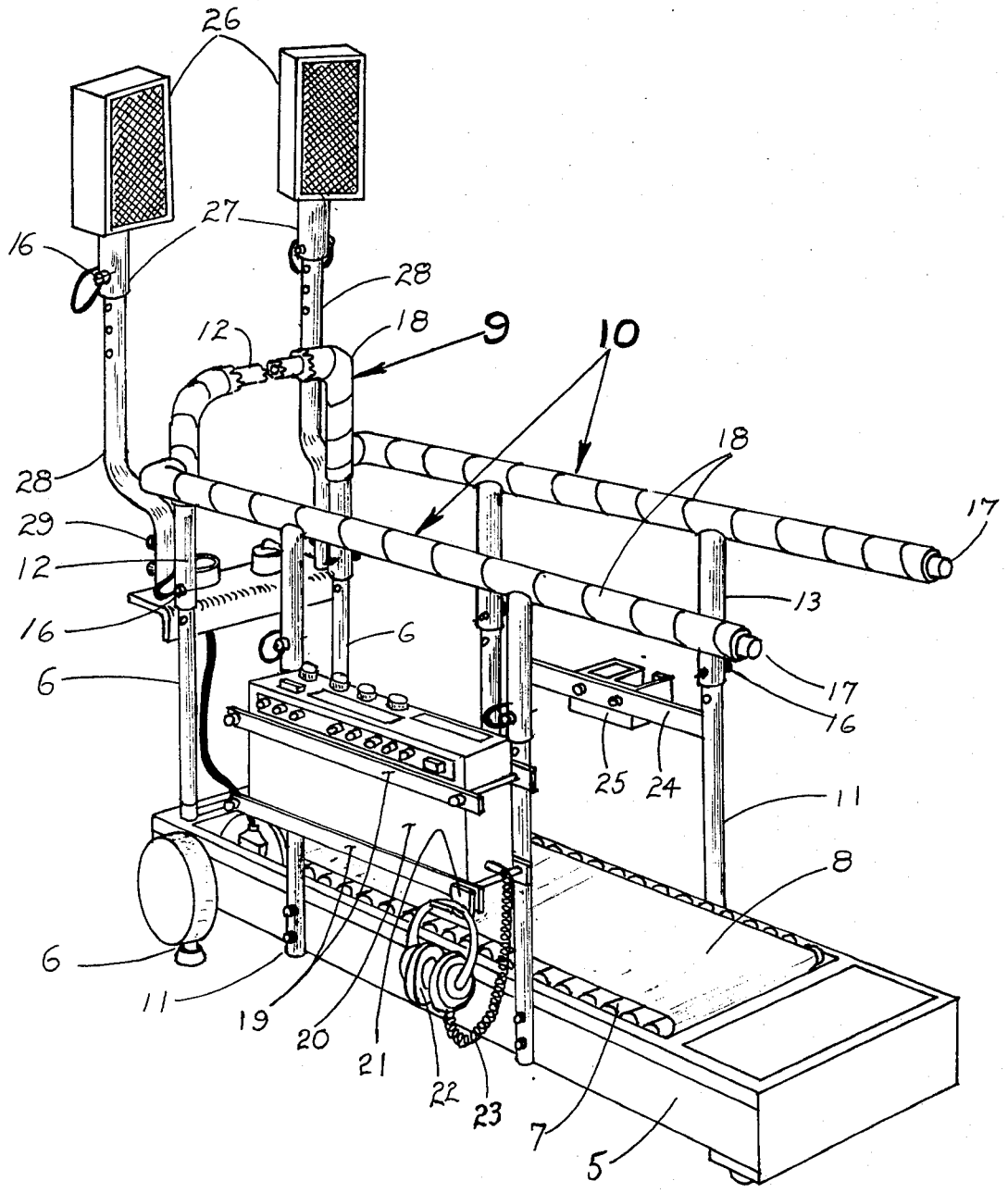
FIG. 1 is a perspective view of a treadmill in accordance therewith ready for use.

The treadmill illustrated by the drawings has an elongated base 5 having vertically adjustable front legs 6 by which the base is usually held forwardly and upwardly inclined. The support for a person using the treadmill consists of a series of closely spaced rollers 7 rotatably supported by the base 5 with a wide belt 8 trained about them so that as the person supported thereby steps forwardly, the belt moves rearwardly. Treadmills typically are provided with means, not shown, by which the resistance of the belt to such rearward movement may be varied to vary the effort required to move it rearwardly without the person moving forwardly.

Treadmills typically are provided with hand grips so that the required effort may be exerted by a person, without moving forward, by use of the hand grips. In accordance with the invention hand grips are provided by a frame, having a front section, generally indicated at 9, shown as U-shaped and inverted, and side sections, generally indicated at 10, each of which is connected to the appropriate one of the sides of the front section and extending the full length of the base 5.

The front legs 6 are of tubular stock and extend a substantial distance above the base as do a pair of tubular posts 11 spaced apart along each side thereof and secured thereto. In order that the frame may be connected to the base, the front section 9 is of tubular stock 12 so dimensioned that its downwardly opening end may slidably receive the upper ends of the posts established by the legs 6.

Figure 2:
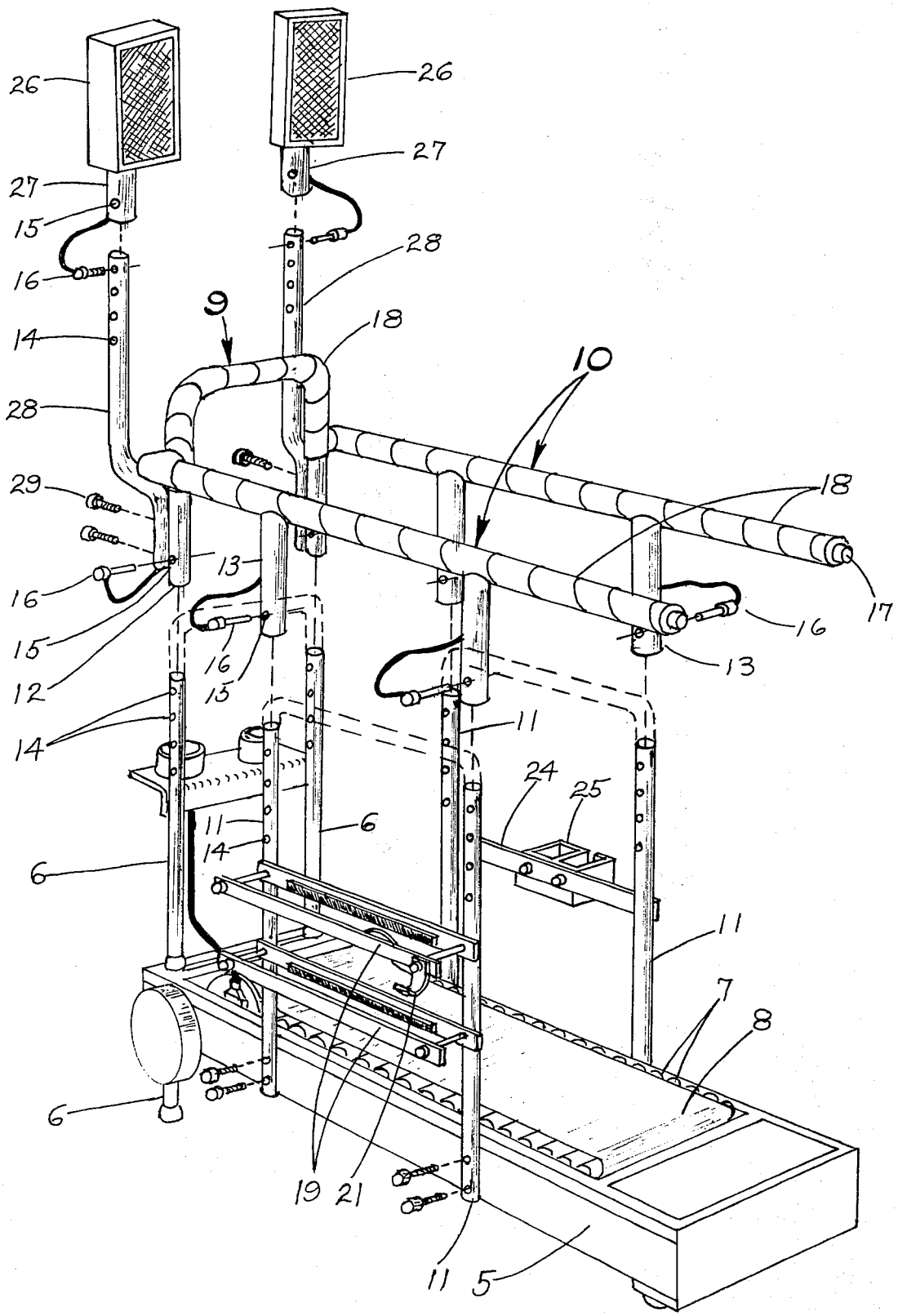
FIG. 2 is a like but exploded view thereof.

The side sections 10 are each provided with similarly dimensioned, downwardly disposed tubular members 12, one for each side post 11. In order that the height of the frame relative to the base 5 can be varied to meet the requirements of the user, each post has, see FIG. 2, a vertically spaced series of transverse bores 14 in its upper end and each end of the tubular stock of the front section and of the tubular members 13 has a transverse bore 15 which, when in registry with a selected one of the bores 14 enables a lock pin 16 to be inserted through them.

Each side section 10 has a metal core 17 which and the tubular stock of the front section 9 are encased in sponge rubber 18 so that any portion of the frame gripped by the user is of substantial cross sectional dimensions and is resiliently yieldable not only affording advantage as hand grips but also avoiding injury or discomfort if accidentally engaged. For the latter reason, the ends of the front section 9 and the members 13 are partly convered in a similar manner.

The posts 11 at one side of the base 5 have a support 19 attached thereto which is disposed and dimensioned to hold a tape deck player 20 and provided with a hook 21 in support of the head band of a pair of ear phones 22 with the connecting cord 23 of a length and type enabling it to be so extended that the ear phones may be worn by any person in any position on the treadmill while exercising. Posts 11 at the other side of the base are interconnected by a member 24 provided with a holder 25.

If preferred by the user, stereo receivers 26 may be used and each is shown as having a depending tubular mount 27. Tubular supports 28, one for each receiver 26 are detachably attached to each side of the front section 9 as at 29. The receivers are connected to the supports in the same way that the frame is connected to the posts, accordingly, the same reference numerals are employed to designate the corresponding transverse bores and lock pins.

Turning now to the method, tapes are used having at least one section a recording of dance or marching music of a length appropriate for an exercise interval. The music is selected by the user, either in making a tape or in selecting a previously prepared tape to have a wanted tempo with the music such as to hold the interest of the user throughout the interval.

In use, because of the appeal of the music to the person while exercising, the rate of his steps is automatically that of the tempo and the type of music typically invites response with frequent movements of his body and arms and changes in his positions lengthwise of and from side-to-side of the belt 8.

It will thus be apparent that the invention makes possible that change of indoor exercising from a monotonous task where the exercise is largely that of leg movements to a pleasurable interval in which exercise is extended to arms and legs. While the tempo of the music and the length of the section may be varied to meet medical limitations, a tempo that compels approximately one hundred twenty steps per minute is preferred as is a section length providing an exercise interval of fifteen minutes.

I claim:

1. A treadmill for use with accompanying dance or marching music, said treadmill including a base, an endless support for a person carried by said base and extending lengthwise thereof and movable by the feet of such a person, framework, and means connecting said framework to said base, said framework including a front, transverse section and side sections connected thereto and extending substantially the full length of said base, each section including a metal core and a resiliently yieldable encasement therefor providing for the full length thereof, a hand grip of substantial cross sectional area wherever grasped by said person as his positions change in response to the tempo and type of the music and a cushion if otherwise engaged, said connecting means including vertical posts secured to the base and depending tubular members attached to the framework and dimensioned slidably to receive within them the upper end of the appropriate post, and means detachably connecting each member to the received post in a selected one of a plurality of vertically spaced positions relative to said support as required by the using person.

2. The treadmill of claim 1 and an external support below one side section disposed and dimensioned to hold a tape deck player, said support attached to selected ones of the posts.

3. The treadmill of claim 2 in which the player includes a pair of ear phones and a connection therewith of sufficient length to enable any such person to wear said phones while occupying any position on said support.

4. The treadmill of claim 2 in which the player includes a pair of stereo speakers and means detachably attaching said speakers to the front section with the speakers spaced apart and above said front section and adjustable vertically relative thereto.

* * * * *